United States Patent [19]

Tachikawa

[11] Patent Number: 4,725,759

[45] Date of Patent: Feb. 16, 1988

[54] PILOT LAMP

[75] Inventor: Teruo Tachikawa, Tokyo, Japan

[73] Assignee: Minipilo Electric Co., Ltd., Tokyo, Japan

[21] Appl. No.: 881,939

[22] Filed: Jul. 3, 1986

[30] Foreign Application Priority Data

Jul. 5, 1985 [JP] Japan ..... 60-147816

[51] Int. Cl.[4] ..... H05B 37/00

[52] U.S. Cl. ..... 315/51; 315/53; 315/306; 315/307; 315/200 R; 323/311

[58] Field of Search ..... 323/311, 313, 317; 315/32, 51, 200 R, 53, 291, 307; 357/75; 307/157

[56] References Cited

U.S. PATENT DOCUMENTS 3,771,018 11/1973 Medendorp et al. ..... 315/200 R
4,211,955 6/1980 Ray ..... 315/53
4,290,004 9/1981 Smith ..... 323/311

*Primary Examiner*—David K. Moore
*Assistant Examiner*—Mark R. Powell
*Attorney, Agent, or Firm*—George B. Oujevolk

[57] ABSTRACT

A conventional pilot lamp which is used in a power plant, substation, or other types of plants, each has its own large and heavy weight transformer below the lamp case. In order to obtain a pilot lamp having the same capacity as the conventional pilot lamp even if the transformer is taken away from the lamp case, the pilot lamp of this invention comprises a lamp, a lamp holder, a heat radiating plate fixed within the lamp holder, an extremely small-sized IC type AC-DC constant voltage regulator connected to the input terminal fixed to the lamp holder, and an output terminal connected to the lamp. Thus, the arrangement contemplated produces a pilot lamp having the same capacity as a conventional pilot lamp, without the large and heavy weight of the transformer unit below the lamp case.

3 Claims, 5 Drawing Figures

PILOT LAMP

BACKGROUND OF THE INVENTION

1. Field of the Invention:

The present invention relates to a pilot lamp unit suitable for use in a power plant, substation, or other types of plants. This would apply to situations where commercial electric current is used.

2. Description of the Prior Art:

Heretofore, the pilot lamp used in a power plant, or other types of plants, is comparatively large (as shown in FIG. 1) because of the large voltage transformer used in conjunction with its operation.

This type of pilot lamp has its large and heavy weight transformer (3) below a lamp case (1) for reducing the ordinary voltage of 100 V~240 V to a lamp voltage of 12 V~24 V. This makes the pilot lamp as a whole inevitably large and heavy with the additional disadvantages of requiring more material and increasing manufacturing cost.

OBJECT OF THE INVENTION

The object of this invention is to provide a pilot lamp unit which is used with commercial AC-DC currents, which is small in comparison to conventional lamps, which can contribute to the saving of resources, and which can be manufactured at low cost.

DESCRIPTION OF PREFERRED EMBODIMENT

Figure 1:
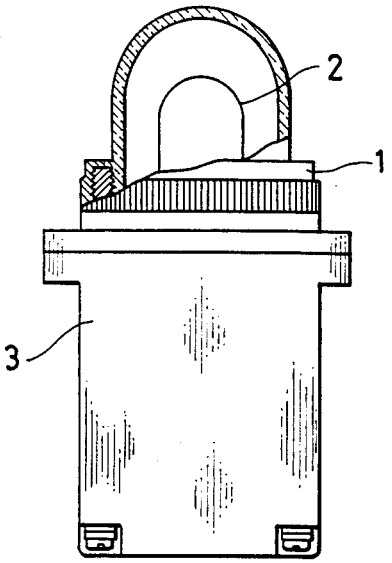
FIG. 1 is a front view partly in section of a conventional pilot lamp.
Figure 2:
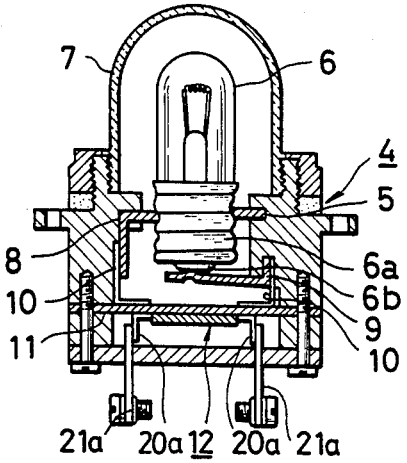
FIG. 2 is a vertical sectional view of a pilot lamp according to the present invention.

Referring to FIG. 2, a base holder (5) is provided within a lamp holder (4) and serves as a socket. The base (6*a*) of a lamp (6) is screwed into the base holder (5) and a bell-type globe (7) is screwed about the upper part of the lamp holder (4) to enclose the lamp (6). From one side of the base holder (5) a conductor (8) is bent downward at a ninety (90) degree angle and another conductor (9) is mounted within the lamp holder (4) in contact with a base terminal (6*b*) of the base (6*a*) of the lamp (6). The conductors (8 and 9) are connected with output terminals (10), which in turn connect to the output terminals of an AC-DC constant voltage regulator (12) which is fixed to a heat radiating plate (11) attached to the bottom of the lamp holder (4).

Figure 4:
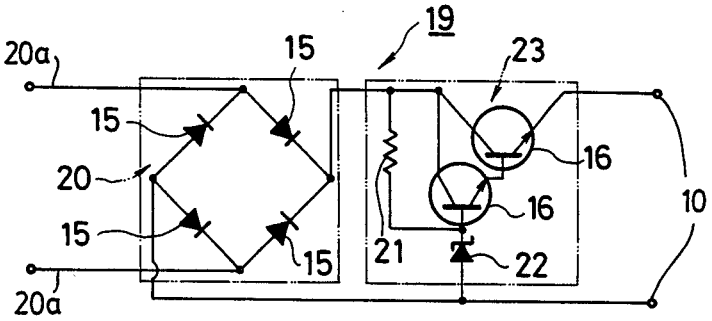
FIG. 4 is a circuit diagram of an AC-DC constant voltage regulator.
Figure 3:
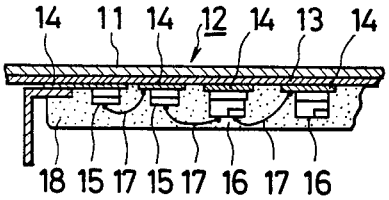
FIG. 3 is a partially enlarged sectional view of a hybrid IC type AC-DC constant voltage regulator.

The AC-DC constant voltage regulator (12) includes an AC-DC constant voltage circuit (19), shown in FIG. 3 and FIG. 4, which has a plurality of conductor patterns (14), made of aluminum, on a heat radiating plate (11), through an insulating layer (13) as shown in FIG. 3. Diode chips (15), resistors, transistor chips (16), and zener diode chips are bonded to the conductor patterns by using a conductive bond or a soldering paste. Thin wires (17) are bonded to provide a hybrid IC and, finally, the entire structure is covered with a resin material (18). As shown in FIG. 4, the circuit (19) comprises a constant voltage circuit (23) which includes a full-wave rectifier circuit (20) formed of four bridge-connected diodes, two transistor chips (16), a resistor (21) and a zener diode (22). As shown in FIG. 2, the input terminals of the circuit connect to input terminals (21*a*) are attached to the lamp holder (4) through lead wires (20*a*).

The diode chips, transistor chips and zener diode chips are all 0.5~1 mm square and the overall size of the circuit (19) is 10 mm×8 mm square with a thickness of about 3 mm. This simplifies the construction from a conventional pilot lamp having its own transformer, and the reductions in size and weight save material and reduce manufacturing costs.

To describe the operation and effects of the present invention: when the ordinary AC power source of 100 V is applied on the input terminals (21*a*), the AC power goes through the full-wave rectifying circuit (20), through the lead wires for rectification, the rectified voltage goes through the constant voltage circuit (23) so that it drops down to a stabilized voltage. The voltage thus obtained is a stabilized DC voltage of 18 V which is applied on the lamp (6) through the lead wires (10) and the conductors (8 and 9). Further, this 18 V DC voltage is not at all affected by variation of the input side voltage with respect to the full-wave rectifier circuit (20). It was found that even when a voltage varing from 80 V up to 240 V was applied, the circuit functioned in a stabilized condition and a constant DC 18V was put out by the output terminal.

It should be noted that the heat radiating plate (11) is adopted to radiate heat in the above case. Further, the above-mentioned AC-DC constant voltage circuit (19) is only an example, and the invention is not limited thereto, as it is possible to change the structure of the constant voltage circuit (23).

Further, the material for the AC-DC constant voltage regulator (12) is not limited to those mentioned but various kinds of other materials can be used. For example, the substrate may be made of ceramic materials, and the conductor patterns and the wires can be made of other various kinds of known materials.

Figure 5:
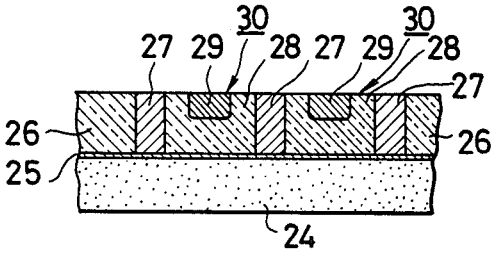
FIG. 5 is a partially enlarged sectional view of a monolithic IC type AC-DC constant voltage regulator.

Although the AC-DC constant voltage regulator of the present invention has been described with respect to the use of the hybrid IC, it may also be formed of a monolithic IC. The circuit structure in this case is the same as the hybrid IC so that a detailed description is omitted. To briefly describe a part of the monolithic IC structure by referring to FIG. 5, the monolithic IC may be formed in the following manner: A n-type silicon layer (26) is provided on a substrate (24) consisting of, for example, a polycrystalline silicon material through an insulating layer (25) of SiO; deep channels are formed in the silicon layer (26) by a chemical etching process; insulating layers (27) are provided among the channels so as to vertically divide the silicon layer (26) into isolated n-type silicon layer (28); and p-type silicon layers (29) are formed on the silicon layers (28) by diffusion so as to form elements such as diodes or transistors.

With the above arrangement, the dielectric strength of the circuit is increased by the insulating layers (25) and (27) so that even when a high power source voltage is directly applied on the circuit, no short circuit takes place. Furthermore, the AC-DC constant voltage circuit of the structure described can be reduced to a size of about 2 mm square and the power source voltage for the circuit can be made equal to that for the hybrid IC as described above.

The input voltage may vary from 80 V to 240 V, for the monolithic IC. Desired DC voltage other than the aforementioned 18 V can be derived from the output side of the circuit by properly changing the value of the resistor, or the rated value of the zener diode.

Moreover, the AC-DC constant voltage circuit (19) can of course be used with a DC power source and the pilot lamp may be in the form of a LED lamp instead of an incandescent lamp.

What is claimed is:

1. A lamp holder (4) for operating a pilot lamp (6), said pilot lamp (6) having a lamp base (6*a*), said lamp holder comprising in combination:

(a) a lamp base holder (5) with receiving means for receiving a lamp base (6*a*);

(b) electrical conductors, one end of said conductors being electrically coupled to said receiving means for contacting a lamp base (6a) inserted therein, and the other end being connected to the output terminals (10) of an AC-DC voltage regulator;

(c) a bottom section to said lamp holder (4) including said terminals (10);

(d) a heat radiating plate (11) horizontally supported in said bottom section;

(e) a plurality of aluminum conductor patterns (14) on said plate (11) also an insulating layer (13) disposed between said plate (11) and said conductor patterns (14);

(f) an integrated circuit supported under said plate (11) defining a diode rectifier bridge coupled to a power transistor means voltage regulator, said voltage regulator including a resistor (21) in parallel with the transistor means and a regulating zener diode (22) coupled to the resistor and the transistor means; and, (g) integrated circuit lead wires (20*a*) feeding AC power across said bridge, also, input terminals (21*a*) connected to said lead wires (20*a*), said input terminals (21*a*) including AC source coupling means, so that when voltage from an AC source is fed to the integrated circuit input terminals (21*a*), the AC power goes through the rectifier bridge for rectification, the rectified voltage then goes through the voltage regulator circuit and drops down to a stabilized low voltage which can be applied to the pilot lamp (6) in the receiving means, across said terminals 10.

2. A lamp holder as claimed in claim 1 wherein said diode rectifier bridge, said power transistor means, said resistor, and said zener diode consist of a four chip full-wave rectifier diode bridge, bonded to said conductor patterns (14), also the power transistor means coupled to said bridge consists of two NPN transistors, the output electrode of one transistor being coupled to the base of the other transistor, and the zener diode is in series with both the resistor and the two transistors.

3. A lamp holder as claimed in claim 1 wherein said diode rectifier bridge, said power transistor means, said resistor and said zener diode are part of a monolithic integrated circuit including a substrate (24) over which is an n-type silicon layer (26), channels etched in the silicon layer (26) with insulating layers (27) along the channels so as to vertically divide the silicon layer into isolated n-type silicon layers (28), with p-type silicon layers (29) formed on the n-type layers, the rectifier bridge being formed of these silicon layers alongside the power transistor voltage regulator circuit.

* * * * *